US007938125B2

(12) United States Patent
John et al.

(10) Patent No.: US 7,938,125 B2
(45) Date of Patent: May 10, 2011

(54) SMOKING ARTICLES AND SMOKABLE FILLER MATERIAL THEREFOR

(75) Inventors: Edward Dennis John, Southampton (GB); Joseph Peter Sutton, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 1198 days.

(21) Appl. No.: 10/575,389

(22) PCT Filed: Oct. 20, 2004

(86) PCT No.: PCT/GB2004/004439

§ 371 (c)(1),
(2), (4) Date: Apr. 10, 2006

(87) PCT Pub. No.: WO2005/044026

PCT Pub. Date: May 19, 2005

(65) Prior Publication Data

US 2007/0062550 A1 Mar. 22, 2007

(30) Foreign Application Priority Data

Oct. 21, 2003 (GB) ..... 0324525.5

(51) Int. Cl.
*A24B 15/00* (2006.01)

(52) U.S. Cl. ..... 131/352; 131/364

(58) Field of Classification Search ..... None
See application file for complete search history.

(56) References Cited

U.S. PATENT DOCUMENTS

| | | | | |
|---|---|---|---|---|
| 3,968,804 | A | | 7/1976 | Kelly et al. |
| 4,333,484 | A | * | 6/1982 | Keritsis ..... 131/359 |
| 4,625,737 | A | | 12/1986 | Keritsis et al. |
| 4,989,620 | A | | 2/1991 | Keritsis et al. |
| 5,129,408 | A | | 7/1992 | Jakob et al. |
| 5,820,998 | A | | 10/1998 | Hotaling et al. |

FOREIGN PATENT DOCUMENTS

| | | | |
|---|---|---|---|
| EP | 0332368 | | 9/1989 |
| EP | 0419975 | * | 4/1991 |
| GB | 1444721 | | 8/1976 |
| JP | 49124299 | * | 11/1974 |
| WO | 9607336 | * | 3/1996 |

* cited by examiner

*Primary Examiner* — Richard Crispino
*Assistant Examiner* — Michael J Felton
(74) *Attorney, Agent, or Firm* — Charles I. Sherman; Middleton Reutlinger

(57) ABSTRACT

The invention relates to smokable filler materials and a process for making same, the smokable filler material comprising a foaming agent, an agent capable of forming chemical cross-linkages, and a cross-linking agent. A combination of the foaming agent in the foamed state thereof, the agent capable of forming chemical crosslinkages and the cross-linking agent provides a stabilized, foamed material. The invention also provides a smoking article incorporating the smokable filler material of the invention.

45 Claims, No Drawings

SMOKING ARTICLES AND SMOKABLE FILLER MATERIAL THEREFOR

CROSS REFERENCE TO PRIOR APPLICATION

This application is a national stage filing (35 U.S.C. 371) of PCT/GB2004/004439, filed on Oct. 20, 2004 which claims priority to and benefit from Great Britain Patent Application No. 0324525.5, filed on Oct. 21, 2003, currently pending.

This invention relates to smokable filler materials and a process for making same.

GB 1 013 303 describes a tobacco-containing foamed sheet material, which material is stabilised by increasing the viscosity of the foam by means of an adhesive, thereby preventing water drainage from the foam. Water drainage from a foam is a mechanism by which the foam collapses and, therefore, eventually loses the air trapped within the structure of the foam.

It is an object of the present invention to provide a smokable filler material having a stabilised foamed structure. The structure of the stabilised foam is such that the foam may be dried whilst substantially maintaining the filling power of the foamed structure.

It is a further object of the present invention to provide a smokable filler material having a stabilised foamed structure, the smokable filler material being capable of being blended with cut tobacco to form the filler of a smoking article or, indeed, being present as the sole filler in a smoking article.

The present invention provides a smokable filler material comprising a foaming agent, an agent capable of forming chemical cross-linkages, and a cross-linking agent, wherein, when combined, the foaming agent in the foamed state thereof, the agent capable of forming chemical cross-linkages and the cross-linking agent provided a stabilised, foamed material.

According to a first aspect of the present invention the foaming agent and the agent capable of forming chemical cross-linkages are provided by the same material, thereby providing a foaming agent capable of forming chemical cross-linkages.

Preferably the foaming agent capable of forming chemical cross-linkages is a foaming alginate. Most preferably the foaming alginate is an esterified alginate. Even more preferably the foaming alginate is propylene glycol alginate or the like.

It is much by preference that the foaming agent capable of forming chemical cross-linkages is present at between about 30% and about 95% by weight of the dry smokable filler material.

Advantageously the cross-linking agent is an agent which provides free calcium ions in aqueous solution. Preferably the cross-linking agent may be a calcium salt which salt is soluble or sparingly soluble at neutral pH (pH 7.0). Suitably the cross-linking agent may be one or more of calcium sulphate, calcium citrate, or the like.

Alternatively the cross-linking agent may be a calcium salt which is insoluble at neutral pH, which salt becomes soluble or sparingly soluble at acidic pH, calcium carbonate or calcium phosphate, for example. Alternatively, the cross-linking agent may be a calcium salt which is soluble or sparingly soluble, which salt forms an alkaline solution, calcium hydroxide for example. It will be clear to the skilled person that any source of free calcium ions may be utilised as a cross-linking agent in the present invention.

When the cross-linking agent consists of a calcium salt, the foaming agent capable of forming chemical cross-linkages is preferably present in the range of about 61% to about 90% by weight of the dry smokable filler material. Even more preferably the foaming agent capable of forming chemical cross-linkages is present in the range of about 71% to about 90% by weight and most preferably between about 81% and 90% by weight of the dry smokable filler material.

When the cross-linking agent consists of a calcium salt, the cross-linking agent is preferably present in the range of between about 1.0% and about 11% by weight of the dry smokable filler material. More preferably the cross-linking agent is present between about 2% and about 5% by weight of the dry smokable filler material.

In an alternative embodiment of the present invention the cross-linking agent may be tobacco material. Advantageously when the cross-linking agent is tobacco the tobacco provides free Ca ions in the presence of water. It will be known to the skilled artisan that different types of tobacco provide different concentrations of free calcium ions in solution, therefore, the tobacco should be present in an amount capable of stabilising the foamed material by cross-linking.

In a further alternative, the smokable filler material may comprise, as a cross-linking agent, both tobacco and a further agent capable of providing free calcium ions. Suitable agents capable of providing free calcium ions and described hereinabove.

When the cross-linking agent is or comprises tobacco material, the foaming agent capable of forming chemical cross-linkages is advantageously present in the range of about 30% to about 80% by weight of the dry smokable filler material, more advantageously at between about 41% to about 70%, even more advantageously between about 51% and about 70% by weight and most advantageously is present in the range of about 61% to 70% by weight of the dry smokable filler material.

When the cross-linking agent is or comprises tobacco material, the tobacco material is preferably present in the range of about 10% to about 60% by weight of the dry smokable filler material. More preferably the tobacco is present at about 20% by weight of the dry smokable filler material.

When the cross-linking agent is a combination of tobacco material and a calcium salt, the calcium salt is advantageously present in the range of about 1.0% to about 6% by weight of the dry smokable filler material. More advantageously the calcium salt is present at between about 1.0% and about 3.0% by weight.

Advantageously the cross-linking agent is present in an amount insufficient to induce syneresis of the stabilised foamed material. Syneresis occurs when the level of cross-linking agent is too great and the stabilised foam material begins to collapse due to the strength of the cross-linkages therein.

It will be understood that the solubility of soluble, or sparingly soluble, calcium salts in aqueous solution under ambient conditions may be changed by means of alterations in temperature, for example. Suitable examples of calcium salts having altered solubility at temperatures other than ambient may be selected by reference to handbooks, such as CRC Handbook of Chemistry and Physics, 83rd Ed. David R. Lide.

Preferably the smokable filler material may further comprise a non-alginic foaming agent. Suitably the non-alginic foaming agent is a foaming agent incapable of forming chemical cross-linkages.

Preferably the non-alginic foaming agent may be a foaming surfactant. Suitably the foaming surfactant may be one or more of the group including celluloses capable of foaming, for example hydroxylpropyl cellulose, methyl cellulose or ethyl cellulose, starch, proteins, for example egg albumin, sugar esters or other suitable foaming agents known to the skilled artisan.

Preferably the smokable filler material may further comprise a non-foaming agent capable of forming chemical cross-linkages.

Advantageously the non-foaming agent capable of forming chemical cross-linkages may be a soluble alginate such as sodium alginate, ammonium alginate or potassium alginate for example. Other suitable non-foaming alginates will be known in the art.

Other agents capable of forming chemical cross-linkages may include pectinaceous materials, for example. It will be understood that these materials may be non-foaming agents capable of forming cross-linkages or, alternatively they may be foaming agents capable of forming chemical cross-linkages. Other foaming and none foaming agents will be readily appreciated by those skilled in the art. It will be further understood that in order that materials may be capable of foaming they may require chemical modification such as esterification, for example.

When the agent capable of forming chemical cross-linkages is pectinaceous, the cross-linking agent may alternatively be an agent which provides multivalent or divalent cations, other than calcium, in solution. Suitable agents will be known to the skilled artisan.

The smokable filler material may alternatively further comprise both a non-alginic foaming agent and a non-foaming agent capable of forming chemical cross-linkages. Suitably the non-alginic foaming agent is a foaming agent incapable of forming chemical cross-linkages.

In accordance with a second aspect of the present invention the foaming agent and the agent capable of forming chemical cross-linkages are provided by different materials.

Preferably the smokable filler material comprises a non-alginic foaming agent. Suitably the non-alginic foaming agent is incapable of forming chemical cross-linkages.

Preferably the non-alginic foaming agent may be a foaming surfactant. Suitably the foaming surfactant may be one or more of the group including celluloses capable of foaming, for example hydroxylpropyl cellulose, methyl cellulose or ethyl cellulose, starch, proteins, for example egg albumin, sugar esters or other suitable foaming agents known to the skilled artisan.

Preferably the non-alginic foaming agent is present in the range of about 0.5% to about 70% by weight of the dry smokable filler material. More preferably the non-alginic foaming agent is present at about 0.5% to about 40% by weight, even more preferably between about 0.5 and about 30% and most preferably is present at between 0.5 and 20% by weight of the dry smokable filler material.

Advantageously the cross-linking agent is an agent which provides free calcium ions in aqueous solution. Preferable cross-linking agents are those described in respect of the first aspect of the present invention.

When the cross-linking agent consists of a calcium salt, the cross-linking agent is preferably present in a range of between about 0.5% and about 50% by weight of the dry smokable filler material. Most preferably the cross-linking agent is present in the range of about 0.5% to about 10% by weight.

Advantageously when the calcium salt is calcium carbonate, the cross-linking agent is present at between about 40% to about 60% by weight of the dry smokable filler material.

It is much by preference that when the cross-linking agent is a combination of tobacco and a calcium salt, the calcium salt is preferably present in a range of about 0.5% to about 8.0% by weight of the dry smokable filler material. More preferably the calcium salt is present at between about 2% and about 4% by weight.

Advantageously when the cross-linking agent is or comprises tobacco, the tobacco is present in the range of about 10% to about 60% by weight of the dry smokable filler material. More advantageously the tobacco is present at about 20% by weight.

When the cross-linking agent consists of a calcium salt, the non-alginic foaming agent is advantageously present in the range of about 0.5% to about 70% by weight of the dry smokable filler material. More advantageously the non-alginic foaming agent is present between about 0.5% and about 30% and most advantageously is present between 0.5 and 20% by weight of the dry smokable filler material.

When the cross-linking agent comprises a calcium salt and tobacco, the non-alginic foaming agent is preferably present in the range of about 2% to about 25% by weight of the dry smokable filler material. More preferably the non-alginic foaming agent is present at between about 2% and about 20% by weight and most preferably is present in the range of about 11% to 20% by weight.

When the cross-linking agent is tobacco the non-alginic foaming agent is preferably present in the range of about 4% to about 35% by weight of the dry smokable filler material. More preferably the non-alginic foaming agent is present at between about 11% and about 30% by weight and is most preferably present in the range of 11% and 20% by weight.

Advantageously the non-foaming agent capable of forming chemical cross-linkages may be a soluble alginate such as sodium alginate, ammonium alginate or potassium alginate for example. Other suitable non-foaming alginates will be known in the art.

It is much by preference that the non-foaming agent capable of forming chemical cross-linkages is present in a range of about 3% to about 70% by weight of the dry smokable filler material. More preferably the non-foaming agent capable of forming chemical cross-linkages is present in the range of about 3% to about 60% by weight, even more preferably the non-foaming agent capable of forming chemical cross-linkages is present between about 11% and about 40% by weight. Most preferably the non-foaming agent capable of forming chemical cross-linkages is present in a range of about 21% to about 30% by weight of the dry smokable filler material.

When the cross-linking agent consists of a calcium salt, the non-foaming agent capable of forming chemical cross-linkages is advantageously present in the range of about 3% to about 70% by weight of the dry smokable filler material. More advantageously the non-alginic foaming agent is present between about 3% and about 60% and most advantageously is present between 3% and 40% by weight of the dry smokable filler material.

When the cross-linking agent comprises a calcium salt and tobacco, the non-foaming agent capable of forming chemical cross-linkages is preferably present in the range of about 3% to about 55% by weight of the dry smokable filler material. More preferably the non-foaming agent capable of forming chemical cross-linkages is present at between about 11% and about 30% by weight and most preferably is present in the range of about 11% to 20% by weight.

When the cross-linking agent is tobacco the non-foaming agent capable of forming chemical cross-linkages is preferably present in the range of about 6% to about 60% by weight of the dry smokable filler material. More preferably the non-foaming agent capable of forming chemical cross-linkages is present at between about 11% and about 50% by weight, even more preferably between about 21% and about 40% by weight and is most preferably present in the range of about 31% and 40% by weight.

Foaming of the foaming agent may be provided by the application of a mechanical force thereto or, alternatively, may be facilitated by the passing of a gas through the foaming agent. Foaming of the foaming agent may also be facilitated under conditions of pressure other than ambient (1 $kg/m^2$). Foaming may be facilitated in vaccuo or under elevated pressure. In a further alternative, foaming may result from a chemical reaction, the reaction resulting in the production of a gas such as carbon dioxide, nitrogen or oxygen, for example. Further alternative means of foaming will be known to the skilled person.

It is much by preference that the smokable filler material of the present invention is a self-supporting foam when dried. Advantageously drying of the stabilised foamed material further stabilises the foamed structure and enables further processing thereof. It will be readily apparent to the skilled person that before drying the cross-linked foamed material is chemically stabilised. It is much by preference that in order to maintain stabilisation the foamed material is dried.

It is much by preference that the moisture content of the dried smokable filler material is in the range of 0% to about 30%. More preferably the moisture content of the dried smokable filler is in the range of about 5% to about 20%. Even more preferably the moisture content is between about 10% to about 15%. Most preferably the moisture content of the dried material is between about 12 to about 15%.

Advantageously the smokable filler material of the present invention is a chemically stabilised foamed material. Preferably the chemically stabilised foamed material substantially maintains a foamed structure upon drying of the material.

The smokable filler material of the present invention may optionally further comprise aerosol generating means, inert filler material, flavourant, colourant, fibrous material, carbonaceous materials, binders and/or tobacco material, or any suitable combination thereof.

Advantageously, when the smokable filler material further comprises aerosol generating means, the aerosol generating means preferably comprises aerosol forming means, such as polyhydric alcohols, glycerol, propylene glycol and triethylene glycol, for example, or esters such as triethyl citrate or triacetin, or high boiling point hydrocarbons. Combinations of the aerosol forming means may also be used.

Preferably the aerosol generating means is present at between 0% and 65% by weight of the dry smokable filler material. More preferably the aerosol generating means is present at between about 1% and about 20% by weight, even more preferably between 5% and 15%. Most preferably the aerosol generating means is present at between about 10% and about 15% by weight.

Preferably, when the foamed smokable filler further comprises inorganic filler material, the inorganic filler material is a particulate material. Advantageously the inorganic filler material is one or more of perlite, zeolite, alumina, vermiculite, diatomaceous earth, colloidal silica, chalk, magnesium oxide, magnesium sulphate, magnesium carbonate or other inorganic filler materials known to those skilled in the art.

Preferably, according to the first aspect of the present invention, the inorganic filler material is present in the range of 0% to about 50% by weight of the dry smokable material. Most preferably the inorganic filler material is present at about 5% by weight.

Preferably, according to the second aspect of the present invention, the inorganic filler material is present in the range of 0% to about 80% by weight of the dry smokable material. More preferably the inorganic filler material is present in the range of about 10% to about 40% by weight. Most preferably the inorganic filler material is present at between about 15% to about 20% by weight.

The smokable filler material may further comprise a colourant to modify the appearance of the material, for example a colourant may darken the material, and/or a flavourant to impart a particular flavour. Suitable flavouring or colourant materials include cocoa, liquorice, caramel, chocolate or toffee, for example. Suitable flavourants include tobacco extract flavours, menthol and vanillin, for example. Other casing and/or flavouring materials may also be suitable.

It is much by preference that the flavourant and/or colourant is present in a range of about 0.2% to about 5% by weight of the dry smokable filler material.

The smokable filler material may further comprise a fibrous material in order to provide the material with one or more of higher strength, lower density or higher fill value. Suitably the fibrous material may be one or more of tobacco, wood pulp, cellulosic or alginic material.

When the fibrous material is other than tobacco, the material is preferably present in a range of 0.5% to about 3.0% by weight of the dry smokable filler material.

When the fibrous material is tobacco, the material is preferably present in a range of 10% to about 60% by weight of the dry smokable filler material. More preferably the tobacco is present at about 20% by weight.

The smokable filler material may further comprise a carbonaceous material. Suitable carbonaceous materials include, carbon, activated carbon in any suitable form. As used herein the term carbonaceous includes material which has been pyrolysed, which material preferably contains carbon, although some incomplete combustion products may still be present.

Preferably the carbonaceous material is present in the dry smokable filler material at between about 0.1% to about 5% by weight.

The smokable filler material may further comprise a binder material. The term binder in the context of the present invention shall be taken as meaning a material other than any of the following: the non-alginic foaming agent, non-foaming pectin or alginate or the foaming agent capable of forming cross-linkages.

Preferably the binder is present at between about 0.5% to about 2.5% by weight of the dry smokable filler material.

The binder material is preferably chemically distinct from the foaming agent and the non-foaming alginate or pectin. It will be apparent to the skilled artisan that certain materials will function as both foaming agents and as binders. Alternatively certain non-foaming agents capable of forming chemical cross-linkages may also function as binders in the present invention. It will be understood that the same, or similar, compounds may be present as a binding material in order that the physical properties of the dried, foamed smokable material be improved. The skilled artisan will be aware of the context of the inclusion of materials which have a dual function as described above. For example, propylene glycol alginate may be foamed and is capable of forming chemical cross-linkages, it may further be present, in the non-foamed state thereof, as a binder. A further example of a dual function material is hydroxypropyl cellulose which may be foamed as a non-alginic foaming agent and/or added in non-foamed state as a binder.

Suitable binders may be organic binders, for example, cellulose derivatives, such as sodium carboxymethylcellulose, methyl cellulose, hydroxylpropylcellulose, hydroxyethyl cellulose or cellulose ethers, alginic binders including soluble alginates such as ammonium alginate, sodium alginate, sodium calcium alginate, calcium ammonium alginate, potassium alginate, magnesium alginate, triethanol-amine alginate and propylene glycol alginate, or insoluble alginates which can be rendered soluble by the addition of solubilising agents, such as ammonium hydroxide. Examples of these include aluminium, copper, zinc and silver alginates. Other organic binders include gums such as gum arabic, gum ghatti, gum tragacanth, Karaya, locust bean, acacia, guar, quince seed or xanthan gum, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Combinations of the above may also be used.

Suitably the smokable filler material may comprise tobacco. The tobacco may be present as a cross-linking agent or, alternatively, may be present in addition to a non-tobacco cross-linking agent.

It is much by preference that when the tobacco is present as a cross-linking agent the tobacco has a small particle size, for example less than 250 μm. It will be understood that tobacco particles of various sizes may be used without deviating from the essence of the invention.

When the tobacco is present in addition to a cross-linking agent, the tobacco may be lamina, stem, fines, dust, reconstituted tobacco or other tobacco material.

The present invention further provides a smoking article comprising a rod of smoking material enwrapped in a wrapper, the smoking material comprising a blend, which blend incorporates the smokable filler material according to the present invention.

It will be understood by the skilled artisan that when referred to herein a "blend" may comprise tobacco and/or tobacco substitute materials.

When the blend consists of tobacco and the smokable filler material according to the invention, the tobacco may be incorporated into the blend in the range of 0% to 90% by weight of the blend and the smokable filler material may be in the range of 10% to 100% of the blend.

Alternatively a smoking article provided in accordance with the present invention may comprise a rod of smoking material enwrapped in a wrapper, the smoking material consisting essentially of the smokable filler material of the present invention.

Preferably the wrapper is a conventional cigarette paper. Alternatively the wrapper may be as previously described in International Patent Publication Number WO 96/07336 or International Patent Publication Number WO 01/41590.

The smokable filler material of the present invention may be in the form of a sheet, which may be an extruded sheet, for example. Suitably if the material is in the form of a sheet, the sheet is shredded or cut before incorporation in a smoking article. Alternatively the smokable filler material according to the present invention may be laminated, thus forming a material having a stabilised foamed interior or layer. In a further alternative the smokable filler material of the present invention may be incorporated into a smoking article as strips or the material may be rolled before being enwrapped in a wrapper.

The present invention even further provides a method of producing a foamed smokable material comprising the steps of:

a) producing a foam from a foaming agent, which foaming agent is capable of forming chemical cross-linkages;

b) mixing said foam with a cross-linking agent;

c) forming a slurry from said mix;

d) casting said slurry, and e) drying said slurry to form a foamed sheet material.

In an alternative arrangement, step a) of a method according to one embodiment of the present invention may comprise the mixing of a foaming agent and a non-foaming agent capable of forming chemical cross-linkages and forming a foam therefrom. The skilled person will readily appreciate that steps b) and c) may be reversed in the described method.

In an alternative embodiment of the present invention there is provided a method of producing a foamed smokable material comprising the steps of:

a) mixing a foaming agent capable of forming cross-linkages and a cross-liking agent; and b) extruding said mixture such that upon exiting an extruder die a stabilised foamed material is provided.

In an alternative arrangement of a method according to the present invention step a) may comprise the mixing of a foaming agent and a non-foaming agent capable of forming chemical cross-linkages with a cross-linking agent.

It will be readily understood from the Foregoing description that the smokable filler material, when produced by extrusion, may be cross-linked before issuing from a die plate and/or after issuing from a die plate. Cross-linkage before issuance from a die plate may be facilitated by the addition of a cross-linking agent to the extrusion mix before the mix is added to the extruder. Alternatively a cross-linking agent may be added into the barrel of the extruder.

Cross-linking may be facilitated after issuance from a die plate. A foamed material may be extruded into a setting bath containing a solution of calcium ions or, alternatively, a solution of calcium ions may be applied to the foamed material by spraying. Alternative processes for stabilising the foamed material during extrusion will be readily appreciated by the skilled artisan.

It will be readily appreciated that the methods described hereinabove may be used to provide any smokable filler material according to the present invention.

In order that the present invention be understood and readily carried into effect reference will now be made to the following examples. The examples should not be taken as limiting the scope of the invention and suitable alternatives not detracting from the essence of the invention will be readily appreciated by the skilled artisan.

EXAMPLE 1

7.5 g propylene glycol alginate (60-70% esterified) was hydrated in 492.5 g water. The hydrated PGA was mixed in a food processor for 5 mins at the highest speed setting of the processor. The PGA was foamed (aerated) by means of a high shear process which served to fractionate the bubbles within the foam. 0.75 g calcium sulphate dihydrate was mixed with the foamed PGA under low shear conditions. The addition of the calcium sulphate dihydrate as a cross-linking agent begins the cross-linking process and causes the foamed PGA to begin form a stabilised foamed material by a gelling process. The resultant slurry was cast onto a flat surface at a depth of 2.5 mm to 3.0 mm. The slurry was dried at 22° C. and 60% relative humidity. The dried cast material was removed from the flat surface using a doctoring blade.

Materials produced according to the described example had a bulk density of between about 10 mg/cc and about 15 mg/cc.

Table 1 shows the constitute materials of Examples 1-7, wherein a slurry was prepared and cast according to the process described in Example 1. All numerical references in Table 1 are expressed as percentages based on the final weight of sheet material and do not include water added during hydration of the materials.

Tables 1a, 1b, 1c and 1d provide examples of smokable filler material in Accordance with the first aspect of the present invention. Table 2 provides examples of smokable filler material in accordance with the second aspect of the present invention.

TABLE 1

| | Examples (Numbers expressed are percentage of sheet components {excluding added water}) | | | | | | |
|---|---|---|---|---|---|---|---|
| | 1 | 2 | 3 | 4 | 5 | 6 | 7 |
| Foaming Agent | | | | | | | |
| Hydroxypropyl cellulose Foaming Agent capable of forming cross-linkages | | 28.2 | | — | 19.7 | 24.7 | |
| Propylene glycol alginate Non Foaming Agent capable of forming cross-linkages | 91.0 | | 50 | 68.2 | | | 85.6 |
| Sodium alginate | | 65.7 | | | 46.0 | 57.8 | |
| Glycerol | | | | 9.9 | 10.0 | 10.1 | 10.0 |
| Caramel | | | | — | — | 2.1 | 2.0 |
| Cross-Linking Agent | | | | | | | |
| Tobacco | — | — | 50 | 20.0 | 20.0 | — | — |
| $CaSO_4$ | 9 | 6.1 | — | 1.9 | 4.3 | 5.3 | 2.4 |

TABLE 1a

| Example | Cross linking foaming agent | Non foaming cross linking agent | | Other additions | % binder |
|---|---|---|---|---|---|
| | | | Cross-linking Agent | | |
| 1 | Propylene Glycol alginate (82.7%) | | $CaSO_4$ (2.3%) | Glycerol (10%) V60 chalk (5%) | 1.5 |
| 2 | Propylene Glycol alginate (82.7%) | | $CaSO_4$ (2.3%) | Glycerol (10%) Vanilla (5%) | 1.5 |
| 3 | Propylene Glycol alginate (87.5%) | | $CaSO_4$ (2.3%) | Glycerol (10%) Midas flavour (0.2%) | 1.5 |
| 4 | Propylene Glycol alginate (82.7%) | | $CaSO_4$ (2.3%) | Glycerol (10%) Liquorice (5%) | 1.5 |
| 5 | Propylene Glycol alginate (86.7%) | | $CaSO_4$ (10.3%) | Wood fibre (3%) | 1.5 |
| 6 | Propylene Glycol alginate (87.1%) | | $CaSO_4$ (2.4%) | Glycerol (10%) Menthol (0.5%) | 1.5 |
| 7 | Propylene Glycol alginate (82.7%) | | $CaSO_4$ (2.3%) | Glycerol (10%) Picactif 40 carbon (5%) | 1.5 |
| 8 | Propylene Glycol alginate (82.7%) | | $CaSO_4$ (2.3%) | Glycerol (10%) Picactif 0% carbon (5%) | 1.5 |
| 9 | Propylene Glycol alginate (82.7%) | | $CaSO_4$ (2.3%) | Glycerol (10%) Guar Gum (5%) | 1.5 |
| 10 | Propylene Glycol alginate (91.2%) | | $CaSO_4$ (2.6%) | Glycerol (6.3%) | 1.5 |
| 11 | Propylene Glycol alginate (66.9%) | | $CaSO_4$ (1.8%) | Glycerol (31.3%) | 1.5 |
| 12 | Propylene Glycol alginate (36.5%) | | $CaSO_4$ (1.0%) | Glycerol (62.5%) | 1.5 |
| | | | Crosslinker | | |
| 13 | Propylene Glycol alginate (77.8%) | | $CaSO_4$ (2.2%) | Glycerol (10%) Tobacco (10%) | 1.5 |
| 14 | Propylene Glycol alginate (58.4%) | | $CaSO_4$ (1.6%) | Glycerol (10%) Tobacco (30%) | 1.5 |
| 15 | Propylene Glycol alginate (48.7%) | | $CaSO_4$ (1.3%) | Glycerol (10%) Tobacco (40%) | 1.5 |
| 16 | Propylene Glycol alginate (29.2%) | | $CaSO_4$ (0.8%) | Glycerol (10%) Tobacco (60%) | 1.5 |
| 17 | Propylene Glycol alginate (80.0%) | | Tobacco (10%) | Glycerol (10%) | 1.5 |
| 18 | Propylene Glycol alginate (60.0%) | | Tobacco (30%) | Glycerol (10%) | 1.5 |
| 19 | Propylene Glycol alginate (50.0%) | | Tobacco (40%) | Glycerol (10%) | 1.5 |

TABLE 1a-continued

| Example | Cross linking foaming agent | Non foaming cross linking agent | | Other additions | % binder |
|---|---|---|---|---|---|
| 20 | Propylene Glycol alginate (30.0%) | | Tobacco (60%) | Glycerol (10%) | 1.5 |
| 21 | Propylene Glycol alginate (88.0%) | | $CaHPO_4$ (2%) | Glycerol (10%) | 1.5 |
| 22 | Propylene Glycol alginate (82.4%) | | Ca Citrate (7.6%) | Glycerol (10%) | 1.5 |
| 23 | Propylene Glycol alginate (64.1%) | | Ca Citrate (5.9%) | Glycerol (10%) Tobacco (20%) | 1.5 |
| 24 | Propylene Glycol alginate (67.2%) | | $CaSO_4$ (2.8%) | Glycerol (10%) Tobacco (20%) | 1.5 |
| 25 | Propylene Glycol alginate (69%) | | $CaSO_4$ (1.0%) | Glycerol (10%) Tobacco (20%) | 1.75 |
| 26 | Propylene Glycol alginate (68.1%) | | $CaSO_4$ (1.9%) | Glycerol (10%) Tobacco (20%) | 2 |
| 27 | Propylene Glycol alginate (69%) | | $CaSO_4$ (1.0%) | Glycerol (10%) Tobacco (20%) | 2 |
| 28 | Propylene Glycol alginate (70%) | | Tobacco (20%) | Glycerol (10%) | 3 |
| 29 | Propylene Glycol alginate (70%) | | Tobacco (20%) | Glycerol (10%) | 2.5 |
| 30 | Propylene Glycol alginate (70%) | | Tobacco (20%) | Glycerol (10%) | 2 |
| 31 | Propylene Glycol alginate (65%) | | Tobacco (20%) | Glycerol (15%) | 2 |
| 32 | Propylene Glycol alginate (70%) | | Tobacco (20%) | Glycerol (10%) | 2 |
| 33 | Propylene Glycol alginate (65%) | | Tobacco (20%) | Glycerol (15%) | 2 |
| 34 | Propylene Glycol alginate (87.6%) | | $CaSO_4$ (2.4%) | Glycerol (10%) | 1.5 |
| 35 | Propylene Glycol alginate (68.5%) | | $CaSO_4$ (1.5%) | Glycerol (10%) | 1.5 |
| 36 | Propylene Glycol alginate (80.4%) | | $CaSO_4$ (9.6%) | Glycerol (10%) | 1.5 |
| 37 | Propylene Glycol alginate (79.6%) | | $CaSO_4$ (9.4%) | Glycerol (10%) Caramel (1%) | 1.5 |
| 38 | Propylene Glycol alginate (85.6%) | | $CaSO_4$ (2.4%) | Glycerol (10%) Caramel (2%) | 1.5 |
| 39 | Propylene Glycol alginate (62.6%) | | $CaSO_4$ (7.4%) | Glycerol (10%) Tobacco dust (20%) | 1.5 |
| 40 | Propylene Glycol alginate (80.4%) | | $CaSO_4$ (9.6%) | Glycerol (10%) | 1.5 |
| 41 | Propylene Glycol Alginate 68.1% | | $CaSO_4$(1.9%) | Glycerol (10%) Tobacco (20%) | 1.5 |
| 42 | Propylene Glycol Alginate 68.1% | | $CaSO_4$(1.9%) | Glycerol (10%) Tobacco (20%) | 3 |
| 43 | Propylene Glycol Alginate 68.1% | | $CaSO_4$(1.9%) | Glycerol (10%) Tobacco (20%) | 2 |
| 44 | Propylene Glycol Alginate 68.1% | | $CaSO_4$(1.9%) | Glycerol (10%) Tobacco (20%) | 2.5 |
| 45 | Propylene Glycol Alginate 69% | | $CaSO_4$(1.0%) | Glycerol (10%) Tobacco (20%) | 1.5 |
| 46 | Propylene Glycol Alginate 68% | | $CaSO_4$(2.0%) | Glycerol (10%) Tobacco (20%) | 1.75 |
| 47 | Propylene Glycol Alginate 67% | | $CaSO_4$(3.0%) | Glycerol (10%) Tobacco (20%) | 2 |
| 48 | Propylene Glycol Alginate 69% | | $CaSO_4$(1.0%) | Glycerol (10%) Tobacco (20%) | 2 |
| 49 | Propylene Glycol Alginate 68% | | $CaSO_4$(2.0%) | Glycerol (10%) Tobacco (20%) | 1.5 |
| 50 | Propylene Glycol Alginate 67% | | $CaSO_4$(3.0%) | Glycerol (10%) Tobacco (20%) | 1.75 |
| 51 | Propylene Glycol Alginate 69% | | $CaSO_4$(1.0%) | Glycerol (10%) Tobacco (20%) | 1.75 |
| 52 | Propylene Glycol Alginate 68% | | $CaSO_4$(2.0%) | Glycerol (10%) Tobacco (20%) | 2 |
| 53 | Propylene Glycol Alginate 67% | | $CaSO_4$(3.0%) | Glycerol (10%) Tobacco (20%) | 1.5 |
| 54 | Propylene Glycol Alginate 69% | | $CaSO_4$(1.0%) | Glycerol (10%) Tobacco (20%) | 2 |
| 55 | Propylene Glycol Alginate 69% | | $CaSO_4$(1.0%) | Glycerol (10%) Tobacco (20%) | 2.5 |
| 56 | Propylene Glycol Alginate 70% | | Tobacco (20%) | Glycerol (10%) | 3 |
| 57 | Propylene Glycol Alginate 58.4% | | $CaSO_4$(1.6%) | Glycerol (10%) Tobacco (20%) | 1.5 |

TABLE 1a-continued

| Example | Cross linking foaming agent | Non foaming cross linking agent | | Other additions | % binder |
|---|---|---|---|---|---|
| 58 | Propylene Glycol Alginate 70% | | Tobacco (20%) | Glycerol (10%) | 2 |
| 59 | Propylene Glycol Alginate 68% | | $CaSO_4$(2.0%) | Glycerol (10%) Tobacco (20%) | 1.5 |
| 60 | Propylene Glycol Alginate 68% | | $CaSO_4$(2.0%) | Glycerol (10%) Tobacco (20%) | 1.5 |
| 61 | Propylene Glycol Alginate 65% | | Tobacco (20%) | Glycerol (15%) | 2 |
| 62 | Propylene Glycol Alginate 70% | | Tobacco (20%) | Glycerol (10%) | 2.25 |
| 63 | Propylene Glycol Alginate 65% | | Tobacco (20%) | Glycerol (15%) | 2.25 |
| 64 | Propylene Glycol Alginate 64.7% | | Tobacco (20%) | Glycerol (15.3%) | 2 |
| 65 | Propylene Glycol Alginate 64% | | Tobacco (21.2%) | Glycerol (14.8%) | 2.25 |

TABLE 1b

| Example | Foaming agent capable of Cross-linking | Non-alginic Foaming agent | Cross-linking agent | Other additions | % binder |
|---|---|---|---|---|---|
| 1 | Propylene glycol alginate (43.7%) | hydroxypropyl cellulose (43.8%) | $CaSO_4$ (2.5%) | Glycerol (10%) | 1.5 |

TABLE 1c

| Example | Foaming Agent Capable of Cross-linking | Non foaming cross linking agent | Cross-linking agent | Other additions | % binder |
|---|---|---|---|---|---|
| 1 | Propylene glycol alginate (43.7%) | Sodium alginate (43.8%) | $CaSO_4$ (2.5%) | Glycerol (10%) | 1.5 |
| 2 | Propylene glycol alginate (43.7%) | Sodium alginate (43.8%) | $CaSO_4$ (1.9%) | Glycerol (10%) Tobacco (20%) | 1.5 |
| 3 | Propylene glycol alginate (43.7%) | Sodium alginate (43.8%) | Tobacco (20%) | Glycerol (10%) | 1.5 |

TABLE 1d

| Example | Foaming agent capable of cross-linking | Non-Alginic Foaming agent | Non foaming cross linking agent | Cross-linking agent | Other additions | % binder |
|---|---|---|---|---|---|---|
| 1 | Propylene Glycol alginate (32.3%) | Hydroxypropyl cellulose (32.3%) | Sodium Alginate (32.3%) | $CaSO_4$ (3.1%) | | 1.5 |
| 2 | Propylene Glycol alginate (32.3%) | Sucrose laurate foaming sugar (32.3%) | Sodium Alginate (32.3%) | $CaSO_4$ (3.1%) | | 1.5 |
| 3 | Propylene Glycol alginate (1%) | Sucrose Laurate sugar ester (1%) | Sodium Alginate (8%) | $CaSO_4$ (1%) | Glycerol (20%) V40S chalk (49%) Menthol (20%) | 1 |

TABLE 2

| Example | Non foaming cross linking agent | Non-Alginic Foaming agent | Cross-linking agent | Other additions | % binder |
|---|---|---|---|---|---|
| 1 | Sodium Alginate (57.9%) | Hydroxypropyl cellulose (24.8%) | CaSO4 (2.3%) | Glycerol (10%) V60 chalk (5%) | 1.5 |
| 2 | Sodium Alginate (57.9%) | Hydroxypropyl cellulose (24.8%) | CaSO4 (2.3%) | Glycerol (10%) Vanilla (5%) | 1.5 |
| 3 | Sodium Alginate (61.3%) | Hydroxypropyl cellulose (26.2%) | CaSO4 (2.3%) | Glycerol (10%) Midas flavour (0.2%) | 1.5 |
| 4 | Sodium Alginate (57.9%) | Hydroxypropyl cellulose (24.8%) | CaSO4 (2.3%) | Glycerol (10%) Liquorice (5%) | 1.5 |
| 5 | Sodium Alginate (61.0%) | Hydroxypropyl cellulose (26.1%) | CaSO4 (2.4%) | Glycerol (10%) Menthol (0.5%) | 1.5 |
| 6 | Sodium Alginate (57.9%) | Hydroxypropyl cellulose (24.8%) | CaSO4 (2.3%) | Glycerol (10%) Picactif 40 carbon (5%) | 1.5 |
| 7 | Sodium Alginate (57.9%) | Hydroxypropyl cellulose (24.8%) | CaSO4 (2.3%) | Glycerol (10%) Picactif 0% carbon (5%) | 1.5 |
| 8 | Sodium Alginate (57.9%) | Hydroxypropyl cellulose (24.8%) | CaSO4 (2.3%) | Glycerol (10%) Guar Gum (5%) | 1.5 |
| 9 | Sodium Alginate (63.8%) | Hydroxypropyl cellulose (27.4%) | CaSO4 (2.6%) | Glycerol (6.3%) | 1.5 |
| 10 | Sodium Alginate (46.8%) | Hydroxypropyl cellulose (20.1%) | CaSO4 (1.8%) | Glycerol (31.3%) | 1.5 |
| 11 | Sodium Alginate (25.6%) | Hydroxypropyl cellulose (10.9%) | CaSO4 (1.0%) | Glycerol (62.5%) | 1.5 |
| 12 | Sodium Alginate (54.5%) | Hydroxypropyl cellulose (23.3%) | CaSO4 (2.2%) | Glycerol (10%) Tobacco (10%) | 1.5 |
| 13 | Sodium Alginate (40.9%) | Hydroxypropyl cellulose (17.5%) | CaSO4 (1.6%) | Glycerol (10%) Tobacco (30%) | 1.5 |
| 14 | Sodium Alginate (34.1%) | Hydroxypropyl cellulose (14.6%) | CaSO4 (1.3%) | Glycerol (10%) Tobacco (40%) | 1.5 |
| 15 | Sodium Alginate (20.4%) | Hydroxypropyl cellulose (8.8%) | CaSO4 (0.8%) | Glycerol (10%) Tobacco (60%) | 1.5 |
| 16 | Sodium Alginate (56%) | Hydroxypropyl cellulose (24%) | Tobacco (10%) | Glycerol (10%) | 1.5 |
| 17 | Sodium Alginate (42%) | Hydroxypropyl cellulose (18%) | Tobacco (30%) | Glycerol (10%) | 1.5 |
| 18 | Sodium Alginate (35%) | Hydroxypropyl cellulose (15%) | Tobacco (40%) | Glycerol (10%) | 1.5 |
| 19 | Sodium Alginate (21%) | Hydroxypropyl cellulose (9%) | Tobacco (60%) | Glycerol (10%) | 1.5 |
| 20 | Sodium Alginate (61.6%) | Hydroxypropyl cellulose (26.4%) | CaHPO4 (2%) | Glycerol (10%) | 1.5 |
| 21 | Sodium Alginate (57.7%) | Hydroxypropyl cellulose (24.7%) | Ca Citrate (7.6%) | Glycerol (10%) | 1.5 |
| 22 | Sodium Alginate (44.9%) | Hydroxypropyl cellulose (19.2%) | Ca Citrate (7.6%) | Glycerol (10%) Tobacco (20%) | 1.5 |
| 23 | Sodium Alginate (17.7%) | Hydroxypropyl cellulose (70.7%) | CaSO4 (1.6%) | Glycerol (10%) | 1.5 |
| 24 | Sodium Alginate (34.8%) | Hydroxypropyl cellulose (52.2%) | CaSO4 (3.0%) | Glycerol (10%) | 1.5 |
| 25 | Sodium Alginate (43.1%) | Hydroxypropyl cellulose (43.2%) | CaSO4 (3.7%) | Glycerol (10%) | 1.5 |
| 26 | Sodium Alginate (51.8%) | Hydroxypropyl cellulose (43.2%) | CaSO4 (3.7%) | Glycerol (10%) | 1.5 |
| 27 | Sodium Alginate (69.0%) | Hydroxypropyl cellulose (17.3%) | CaSO4 (3.7%) | Glycerol (10%) | 1.5 |
| 28 | Sodium Alginate (16.7%) | Hydroxypropyl cellulose (66.6%) | CaSO4 (6.7%) | Glycerol (10%) | 1.5 |
| 29 | Sodium Alginate (31.1%) | Hydroxypropyl cellulose (46.6%) | CaSO4 (12.3%) | Glycerol (10%) | 1.5 |
| 30 | Sodium Alginate (37.6%) | Hydroxypropyl cellulose (37.5%) | CaSO4 (14.9%) | Glycerol (10%) | 1.5 |
| 31 | Sodium Alginate (43.6%) | Hydroxypropyl cellulose (29.0%) | CaSO4 (17.4%) | Glycerol (10%) | 1.5 |
| 32 | Sodium Alginate (54.6%) | Hydroxypropyl cellulose (13.7%) | CaSO4 (21.7%) | Glycerol (10%) | 1.5 |
| 33 | Sodium Alginate (57.8%) | Hydroxypropyl cellulose (24.7%) | CaSO4 (5.5%) | Glycerol (10%) Caramel (2%) | 1.5 |
| 34 | Sodium Alginate (56.4%) | Hydroxypropyl cellulose (24.2%) | CaSO4 (7.4%) | Glycerol (10%) Caramel (2%) | 1.5 |
| 35 | Sodium Alginate (51.1%) | Hydroxypropyl cellulose (34.1%) | CaSO4 (4.8%) | Glycerol (10%) | 1 |
| 36 | Sodium Alginate (67.0%) | Hydroxypropyl cellulose (16.8%) | CaSO4 (6.2%) | Glycerol (10%) | 1 |
| 37 | Sodium Alginate (59.2%) | Hydroxypropyl cellulose (25.3%) | CaSO4 (5.5%) | Glycerol (10%) | 1 |
| 38 | Sodium Alginate (47.0%) | Hydroxypropyl cellulose (31.4%) | CaSO4 (11.6%) | Glycerol (10%) | 1 |
| 39 | Sodium Alginate (46.1%) | Hydroxypropyl cellulose (19.7%) | CaSO4 (4.2%) | Glycerol (10%) Tobacco (20%) | 1 |

TABLE 2-continued

| Example | Non foaming cross linking agent | Non-Alginic Foaming agent | Cross-linking agent | Other additions | % binder |
|---|---|---|---|---|---|
| 40 | Sodium Alginate (55.0%) | Hydroxypropyl cellulose (23.6%) | CaSO4 (4.2%) | Glycerol (10%) Caramel (2%) | 1 |
| 41 | Sodium Alginate (46.1%) | Hydroxypropyl cellulose (19.7%) | CaSO4 (4.2%) | Glycerol (10%) Tobacco (20%) | 3 |
| 42 | Sodium Alginate (46.1%) | Hydroxypropyl cellulose (19.7%) | CaSO4 (4.2%) | Glycerol (10%) Tobacco (20%) | 2 |
| 43 | Sodium Alginate (46.1%) | Hydroxypropyl cellulose (19.7%) | CaSO4 (4.2%) | Glycerol (10%) Tobacco (20%) | 2.5 |
| 44 | Sodium Alginate (57.9%) | Hydroxypropyl cellulose (24.8%) | CaSO4 (2.2%) | Glycerol (10%) Menthol (5%) | 1.5 |
| 45 | Sodium Alginate (54.5%) | Hydroxypropyl cellulose (23.3%) | CaSO4 (2.2%) | Glycerol (10%)Tobacco (10%) | 1.5 |
| 46 | Sodium Alginate (45.5%) | Hydroxypropyl cellulose (19.5%) | Tobacco (20%) | Glycerol (15%) | 2 |
| 47 | Sodium Alginate (49.0%) | Hydroxypropyl cellulose (21.0%) | Tobacco (20%) | Glycerol (10%) | 2 |
| 48 | Sodium Alginate (45.5%) | Hydroxypropyl cellulose (19.5%) | Tobacco (20%) | Glycerol (15%) | 1.5 |
| 49 | Sodium Alginate (49.0%) | Hydroxypropyl cellulose (21.0%) | Tobacco (20%) | Glycerol (10%) | 1.5 |
| 50 | Sodium Alginate (45.5%) | Hydroxypropyl cellulose (19.5%) | Tobacco (20%) | Glycerol (15%) | 3 |
| 51 | Sodium Alginate (49.0%) | Hydroxypropyl cellulose (21.0%) | Tobacco (20%) | Glycerol (10%) | 3 |
| 52 | Sodium Alginate (39%) | Hydroxypropyl cellulose (26.0%) | Tobacco (20%) | Glycerol (15%) | 2 |
| 53 | Sodium Alginate (32.5%) | Hydroxypropyl cellulose (32.5%) | Tobacco (20%) | Glycerol (15%) | 2 |
| 54 | Sodium Alginate (39%) | Hydroxypropyl cellulose, low viscosity (26.0%) | Tobacco (20%) | Glycerol (15%) | 3 |
| 55 | Sodium Alginate (39%) | Hydroxypropyl cellulose, medium viscosity (26.0%) | Tobacco (20%) | Glycerol (15%) | 3 |
| 56 | Sodium Alginate (39%) | Hydroxypropyl cellulose, low viscosity (26.0%) | Tobacco (20%) | Glycerol (15%) | 2.5 |
| 57 | Sodium Alginate (39%) | Hydroxypropyl cellulose, low and medium viscosity (26.0%) | Tobacco (20%) | Glycerol (15%) | 2.5 |
| 58 | Sodium Alginate (39%) | Hydroxypropyl cellulose, low and high viscosity (26.0%) | Tobacco (20%) | Glycerol (15%) | 2.5 |
| 59 | Sodium Alginate (39%) | Hydroxypropyl cellulose, low and high viscosity (26.0%) | Tobacco (20%) | Glycerol (15%) | 2 |
| 60 | Sodium Alginate (39%) | Hydroxypropyl cellulose, low and high viscosity (26.0%) | Tobacco (20%) | Glycerol (15%) | 2.25 |
| 61 | Sodium Alginate (45%) | Hydroxypropyl cellulose, low and high viscosity (30.0%) | Tobacco (20%) | Glycerol (5%) | 2.25 |
| 62 | Sodium Alginate (27%) | Hydroxypropyl cellulose, low and high viscosity (18%) | Tobacco (40%) | Glycerol (15%) | 2.25 |
| 63 | Sodium Alginate (33%) | Hydroxypropyl cellulose, low and high viscosity (22%) | Tobacco (40%) | Glycerol (5%) | 2.25 |
| 64 | Sodium Alginate (33%) | Hydroxypropyl cellulose, low and high viscosity (22%) | Tobacco (30%) | Glycerol (15%) | 2.25 |
| 65 | Sodium Alginate (39%) | Hydroxypropyl cellulose, low and high viscosity (26%) | Tobacco (30%) | Glycerol (5%) | 2.25 |
| 66 | Sodium Alginate (27%) | Hydroxypropyl cellulose, low and high viscosity (18%) | Tobacco (40%) | Glycerol (15%) | 1.5 |
| 67 | Sodium Alginate (27%) | Hydroxypropyl cellulose, low and high viscosity (18%) | Tobacco (40%) | Glycerol (15%) | 1.75 |
| 68 | Sodium Alginate (27%) | Hydroxypropyl cellulose, low and high viscosity (18%) | Tobacco (40%) | Glycerol (15%) | 1.25 |
| 69 | Sodium Alginate (27%) | Hydroxypropyl cellulose, low and high viscosity (18%) | Tobacco (40%) | Glycerol (15%) | 1 |
| 70 | Sodium Alginate (22.5%) | Hydroxypropyl cellulose, low and high viscosity (22.5%) | Tobacco (40%) | Glycerol (15%) | 1 |
| 71 | Sodium Alginate (18%) | Hydroxypropyl cellulose, low and high viscosity (27%) | Tobacco (40%) | Glycerol (15%) | 1 |
| 72 | Sodium Alginate (27%) | Hydroxypropyl cellulose, high viscosity (18%) | Tobacco (40%) | Glycerol (15%) | 1 |
| 73 | Sodium Alginate (27%) | Hydroxypropyl cellulose, low and high viscosity (18%) | Tobacco (40%) | Glycerol (15%) | 0.9 |
| 74 | Sodium Alginate (27%) | Hydroxypropyl cellulose, low and high viscosity (18%) | Tobacco (40%) | Glycerol (15%) | 0.8 |
| 75 | Sodium Alginate (27%) | Hydroxypropyl cellulose, low and high viscosity (18%) | Tobacco (40%) | Glycerol (15%) | 0.95 |
| 76 | Sodium Alginate (29.3%) | Hydroxypropyl cellulose, low and high viscosity (15.7%) | Tobacco (40%) | Glycerol (15%) | 0.95 |
| 77 | Sodium Alginate (27%) | Hydroxypropyl cellulose, low and high viscosity (18%) | Tobacco (20%) | Glycerol (15%), V40 chalk (20%) | 2.25 |

TABLE 2-continued

| Example | Non foaming cross linking agent | Non-Alginic Foaming agent | Cross-linking agent | Other additions | % binder |
|---|---|---|---|---|---|
| 78 | Sodium Alginate (27%) | Hydroxypropyl cellulose, low and high viscosity (18%) | Tobacco (20%) | Glycerol (15%), V60 chalk (20%) | 2.25 |
| 79 | Sodium Alginate (27%) | Hydroxypropyl cellulose, low and high viscosity (18%) | Tobacco (20%) | Glycerol (15%), V40 chalk (20%) | 1.5 |
| 80 | Sodium Alginate (27%) | Hydroxypropyl cellulose, low and high viscosity (18%) | Tobacco (20%) | Glycerol (15%), V60 chalk (20%) | 1.5 |
| 81 | Sodium Alginate low viscosity (27%) | Hydroxypropyl cellulose, low and high viscosity (18%) | Tobacco (40%) | Glycerol (15%) | 1.25 |
| 82 | Sodium Alginate (27%) | Hydroxypropyl cellulose, low and high viscosity (18%) | Tobacco (20%) | Glycerol (15%), V40 chalk (20%) | 1 |
| 83 | Sodium Alginate (27%) | Hydroxypropyl cellulose, low and high viscosity (18%) | Tobacco (20%) | Glycerol (15%), V60 chalk (20%) | 1 |
| 84 | Sodium Alginate low viscosity (27%) | Hydroxypropyl cellulose, low and high viscosity (18%) | Tobacco (40%) | Glycerol (15%) | 1.5 |
| 85 | Sodium Alginate low viscosity (27%) | Hydroxypropyl cellulose, low and high viscosity (18%) | Tobacco (40%) | Glycerol (15%) | 1.75 |
| 86 | Sodium Alginate (27%) | Hydroxypropyl cellulose, low and high viscosity (18%) | Tobacco (20%) | Glycerol (15%), V40 chalk (20%) | 1.25 |
| 87 | Sodium Alginate (27%) | Hydroxypropyl cellulose, low and high viscosity (18%) | Tobacco (20%) | Glycerol (15%), V60 chalk (20%) | 1.25 |
| 88 | Sodium Alginate (27%) | Hydroxypropyl cellulose, low and high viscosity (18%) | Tobacco (20%) | Glycerol (15%), precipitated chalk (20%) | 1.25 |
| 89 | Sodium Alginate (27%) | Hydroxypropyl cellulose, low and high viscosity (18%) | Tobacco (20%) | Glycerol (15%), V100 chalk (20%) | 1.25 |
| 90 | Sodium Alginate (27%) | Hydroxypropyl cellulose, low and high viscosity (18%) | Tobacco (20%) | Glycerol (15%), V40S chalk (20%) | 1.25 |
| 91 | Sodium Alginate (29%) | Sucrose laurate sugar ester (29%) | Tobacco (24%) | Glycerol (18%) | 2.25 |
| 92 | Sodium Alginate (32.5%) | Sucrose stearate sugar ester (32.5%) | Tobacco (20%) | Glycerol (15%) | 2.25 |
| 93 | Sodium Alginate (32.5%) | Sucrose oleate sugar ester (32.5%) | Tobacco (20%) | Glycerol (15%) | 2.25 |
| 94 | Sodium Alginate (32.5%) | Sucrose laurate sugar ester (32.5%) | Tobacco (20%) | Glycerol (15%) | 2.25 |
| 95 | Sodium Alginate (32.5%) | Sucrose stearate/palmitate sugar ester (32.5%) | Tobacco (20%) | Glycerol (15%) | 2.25 |
| 96 | Sodium Alginate (32.5%) | Sucrose palmitate sugar ester (32.5%) | Tobacco (20%) | Glycerol (15%) | 2.25 |
| 97 | Modified potato pectin (32.5%) | Sucrose stearate/palmitate sugar ester (32.5%) | Tobacco (20%) | Glycerol (15%) | 2.25 |
| 98 | Sodium Alginate (15%) | Hydroxypropyl cellulose, low and high viscosity (10%) | Tobacco (40%) | Glycerol (15%), V40S chalk (20%) | 1 |
| 99 | Sodium Alginate (15%) | Hydroxypropyl cellulose, low and high viscosity (10%) | Tobacco (20%) | Glycerol (15%), V40S chalk (40%) | 1 |
| 100 | Sodium Alginate (15%) | Hydroxypropyl cellulose, low and high viscosity (10%) | Tobacco (40%) | Glycerol (15%), V40S chalk (20%) | 0.8 |
| 101 | Sodium Alginate (15%) | Hydroxypropyl cellulose, low and high viscosity (10%) | Tobacco (20%) | Glycerol (15%), V40S chalk (40%) | 0.8 |
| 102 | Sodium Alginate (15%) | Hydroxypropyl cellulose, low and high viscosity (10%) | Tobacco (35%) | Glycerol (20%), V40S chalk (20%) | 1 |
| 103 | Sodium Alginate (15%) | Hydroxypropyl cellulose, low and high viscosity (10%) | Tobacco (20%) | Glycerol (20%), V40S chalk (35%) | 1 |
| 104 | Sodium Alginate (24%) | Hydroxypropyl cellulose, low and high viscosity (16%) | V40S chalk (40%) | Glycerol (20%) | 1 |
| 105 | Sodium Alginate (24%) | Hydroxypropyl cellulose, low and high viscosity (16%) | V40S chalk (40%) | Glycerol (20%) | 1.5 |
| 106 | Sodium Alginate (15%) | Hydroxypropyl cellulose, low and high viscosity (10%) | Tobacco (35%) | Glycerol (30%), V40S chalk (10%) | 1 |
| 107 | Sodium Alginate (15%) | Hydroxypropyl cellulose, low and high viscosity (10%) | Tobacco (20%) | Glycerol (30%), V40S chalk (25%) | 1 |
| 108 | Sodium Alginate (12%) | Hydroxypropyl cellulose, low and high viscosity (8%) | V40S chalk (60%) | Glycerol (20%) | 1 |
| 109 | Sodium Alginate (12%) | Hydroxypropyl cellulose, low and high viscosity (8%) | V40S chalk (60%) | Glycerol (20%) | 1.5 |
| 110 | Sodium Alginate (12%) | Hydroxypropyl cellulose, low and high viscosity (8%) | V40S chalk (60%) | Glycerol (20%) | 2 |
| 111 | Sodium Alginate (12%) | Hydroxypropyl cellulose, low and high viscosity (8%) | V40S chalk (50%) | Glycerol (30%) | 2 |
| 112 | Sodium Alginate (15%) | Hydroxypropyl cellulose, low and high viscosity (10%) | Tobacco (10%) | Glycerol (40%), V40S chalk (25%) | 1 |
| 113 | Sodium Alginate (15%) | Hydroxypropyl cellulose, low and high viscosity (10%) | Tobacco (25%) | Glycerol (40%), V40S chalk (10%) | 1 |
| 114 | Sodium Alginate (12%) | Hydroxypropyl cellulose, low and high viscosity (8%) | CaSO4 (1%) | Glycerol (20%) V40S chalk (59%) | 2 |
| 115 | Sodium Alginate (12%) | Hydroxypropyl cellulose, low and high viscosity (8%) | CaSO4 (3%) | Glycerol (20%) V40S chalk (57%) | 2 |

TABLE 2-continued

| Example | Non foaming cross linking agent | Non-Alginic Foaming agent | Cross-linking agent | Other additions | % binder |
|---|---|---|---|---|---|
| 116 | Sodium Alginate (12%) | Hydroxypropyl cellulose, low and high viscosity (8%) | CaSO4 (5.6%) | Glycerol (20%) V40S chalk (54.4%) | 2 |
| 117 | Sodium Alginate (12%) | Hydroxypropyl cellulose, low and high viscosity (8%) | CaSO4 (5.6%) | Glycerol (30%) V40S chalk (44.4%) | 2 |
| 118 | Sodium Alginate (12%) | Hydroxypropyl cellulose, low and high viscosity (8%) | CaSO4 (2%) | Glycerol (20%) V40S chalk (58%) | 2 |
| 119 | Sodium Alginate (9%) | Hydroxypropyl cellulose, low and high viscosity (6%) | CaSO4 (2%) | Glycerol (20%) V40S chalk (63%) | 2 |
| 120 | Sodium Alginate (12%) | Hydroxypropyl cellulose, low and high viscosity (8%) | CaSO4 (3%) | Glycerol (20%) V40S chalk (57%), Caramel (1%) | 2 |
| 121 | Sodium Alginate (9%) | Hydroxypropyl cellulose, low and high viscosity (6%) | CaSO4 (2.3%) | Glycerol (20%) V40S chalk (61.7%) Caramel (1%) | 2 |
| 122 | Sodium Alginate (9%) | Hydroxypropyl cellulose, low and high viscosity (6%) | CaSO4 (3%) | Glycerol (20%) V40S chalk (61%) Caramel (1%) | 2 |
| 123 | Sodium Alginate (9%) | Hydroxypropyl cellulose, low and high viscosity (6%) | CaSO4 (3%) | Glycerol (20%) V40S chalk (61%) Caramel (1%) | 1.5 |
| 124 | Sodium Alginate (6%) | Hydroxypropyl cellulose, low and high viscosity (4%) | CaSO4 (2%) | Glycerol (20%) V40S chalk (67%) Caramel (1%) | 1.5 |
| 125 | Sodium Alginate (6%) | Hydroxypropyl cellulose, low and high viscosity (4%) | CaSO4 (2%) | Glycerol (30%) V40S chalk (57%) Caramel (1%) | 1.5 |
| 126 | Sodium Alginate (3%) | Hydroxypropyl cellulose, low and high viscosity (2%) | CaSO4 (1%) | Glycerol (30%) V40S chalk (63%) Caramel (1%) | 1.5 |
| 127 | Sodium Alginate (3%) | Hydroxypropyl cellulose, low and high viscosity (2%) | CaSO4 (1%) | Glycerol (30%) V40S chalk (63%) Caramel (1%) | 1 |
| 128 | Sodium Alginate (3%) | Hydroxypropyl cellulose, low and high viscosity (2%) | CaSO4 (1.5%) | Glycerol (30%) V40S chalk (62.5%) Caramel (1%) | 1 |
| 129 | Sodium Alginate (6%) | Sucrose Laurate sugar ester (12%) | Tobacco(40%) | Glycerol (20%) V40S chalk (20%) | 1 |
| 130 | Sodium Alginate (6%) | Sucrose Oleate sugar ester (12%) | Tobacco(40%) | Glycerol (20%) V40S chalk (20%) | 1 |
| 131 | Sodium Alginate (3%) | Hydroxypropyl cellulose, low and high viscosity (2%) | CaSO4 (1%) | Glycerol (25%) V40S chalk (68%) Caramel (1%) | 1 |
| 132 | Sodium Alginate (3%) | Hydroxypropyl cellulose, low and high viscosity (2%) | CaSO4 (1%) | Glycerol (12.5%) V40S chalk (80.5%) Caramel (1%) | 1 |
| 133 | Sodium Alginate (4%) | Hydroxypropyl cellulose, low and high viscosity (1%) | CaSO4 (1%) | Glycerol (25%) V40S chalk (68%) Caramel (1%) | 1 |
| 134 | Sodium Alginate (4.5%) | Hydroxypropyl cellulose, low and high viscosity (0.5%) | CaSO4 (1%) | Glycerol (25%) V40S chalk (68%) Caramel (1%) | 1 |
| 135 | Sodium Alginate (4%) | Hydroxypropyl cellulose, low and high viscosity (1%) | CaSO4 (1.59%) | Glycerol (25%) V40S chalk (67.41%) Caramel (1%) | 1 |
| 136 | Sodium Alginate (4%) | Sucrose Laurate sugar ester (1%) | CaSO4 (1.59%) | Glycerol (25%) V40S chalk (67.41%) Caramel (1%) | 1 |
| 137 | Sodium Alginate (4.7%) | Hydroxypropyl cellulose, low and high viscosity (1.2%) | CaSO4 (1.59%) | Glycerol (12.5%) V100 chalk (78.5%) Caramel (1.5%) | 2.2 |
| 138 | Sodium Alginate (16%) | Hydroxypropyl cellulose, low and high viscosity (4%) | CaSO4 (3%) | Glycerol (20%) V40S chalk (17%) Tobacco (40%) | 1 |
| 139 | Sodium Alginate (16%) | Hydroxypropyl cellulose, low and high viscosity (4%) | CaSO4 (3%) | Glycerol (20%) V40S chalk (37%) Tobacco (20%) | 1 |
| 140 | Sodium Alginate (6%) | Hydroxypropyl cellulose, low and high viscosity (4%) | CaSO4 (1%) | Glycerol (20%) V40S chalk (49%) Menthol (20%) | 1 |
| 141 | Sodium Alginate (8%) | Sucrose Laurate sugar ester (2%) | CaSO4 (1%) | Glycerol (20%) V40S chalk (49%) Menthol (20%) | 1 |
| 142 | Sodium Alginate (16%) | Hydroxypropyl cellulose, low and high viscosity (4%) | Tobacco (40%) | Glycerol (20%) V40S chalk (20%) | 1 |
| 143 | Sodium Alginate (16%) | Hydroxypropyl cellulose, low and high viscosity (4%) | Tobacco (20%) | Glycerol (20%) V40S chalk (40%) | 1 |
| 144 | Sodium Alginate (4%) | Hydroxypropyl cellulose, low and high viscosity (1%) | CaSO4 (1.59%) | Glycerol (25%) V40S chalk (68.41%) | 0.5 |
| 145 | Sodium Alginate (4%) | Hydroxypropyl cellulose, low and high viscosity (1%) | CaSO4 (1.59%) | Glycerol (25%) V40S chalk (68.41%) | 0.75 |
| 146 | Sodium Alginate (4%) | Hydroxypropyl cellulose, low and high viscosity (1%) | CaSO4 (1.59%) | Glycerol (25%) V40S chalk (68.41%) | 1 |
| 147 | Sodium Alginate (4%) | Hydroxypropyl cellulose, low and high viscosity (1%) | CaSO4 (1.59%) | Glycerol (25%) V40S chalk (68.41%) | 1.5 |
| 148 | Sodium Alginate (4%) | Hydroxypropyl cellulose, low and high viscosity (1%) | CaSO4 (1.59%) | Glycerol (25%) V40S chalk (68.41%) | 0.25 |
| 149 | Sodium Alginate (4%) | Sucrose Laurate sugar ester (1%) | CaSO4 (1.59%) | Glycerol (25%) V40S chalk (68.41%) | 1 |
| 150 | Sodium Alginate (4%) | Sucrose Laurate sugar ester (1%) | CaSO4 (1.59%) | Glycerol (25%) V40S chalk (68.41%) | 0.5 |
| 151 | Sodium Alginate (4%) | Sucrose Laurate sugar ester (1%) | CaSO4 (1.59%) | Glycerol (25%) V40S chalk (68.41%) | 1.5 |
| 152 | Sodium Alginate (4%) | Sucrose Laurate sugar ester (1%) | CaSO4 (1.59%) | Glycerol (25%) V40S chalk (68.41%) | 0.25 |

TABLE 2-continued

| Example | Non foaming cross linking agent | Non-Alginic Foaming agent | Cross-linking agent | Other additions | % binder |
|---|---|---|---|---|---|
| 153 | Sodium Alginate (3%) | Hydroxypropyl cellulose, low and high viscosity (2%) | CaSO4 (1.4%) | Glycerol (25%) V40S chalk (58.6%), tobacco (10%) | 1 |
| 154 | Sodium Alginate (5.7%) | Hydroxypropyl cellulose, low and high viscosity (3.8%) | CaSO4 (2.7%) | Glycerol (23.8%) V40S chalk (54.5%), tobacco (9.5%) | 1 |
| 155 | Sodium Alginate (7.6%) | Sucrose Laurate sugar ester (1.9%) | CaSO4 (2.7%) | Glycerol (23.8%) V40S chalk (54.5%), tobacco (9.5%) | 1 |
| 156 | Sodium Alginate (10.4%) | Hydroxypropyl cellulose, low and high viscosity (7.0%) | CaSO4 (4.9%) | Glycerol (21.7%) V40S chalk (47.3%), tobacco (8.7%) | 1 |
| 157 | Sodium Alginate (13.9%) | Sucrose Laurate sugar ester (3.5%) | CaSO4 (4.9%) | Glycerol (21.7%) V40S chalk (47.3%), tobacco (8.7%) | 1 |
| 158 | Sodium Alginate (16%) | Hydroxypropyl cellulose, low and high viscosity (4.0%) | CaSO4 (5.6%) | Glycerol (25%) V40S chalk (39.4%), tobacco (10%) | 1 |
| 159 | Sodium Alginate (16%) | Sucrose Laurate sugar ester (4%) | CaSO4 (5.6%) | Glycerol (25%) V40S chalk (39.4%), tobacco (10%) | 1 |
| 160 | Sodium Alginate (60.6%) | Sugar Laurate sugar ester (15.2%) | CaSO4 (24.2%) | | 1.5 |
| 161 | Sodium Alginate (26.4%) | Sugar Laurate sugar ester (3.3%) | Ca Citrate (34.9%) | Glycerol (38.7%) | 1.35 |
| 162 | Sodium Alginate (26%) | Sugar Laurate sugar ester (2.2%) | Ca Citrate (34.4%) | Glycerol (37.5%) | 1.3 |
| 163 | Sodium Alginate (26.4%) | Sugar Laurate sugar ester (1.1%) | Ca Citrate (35%) | Glycerol (37.5%) | 1.25 |
| 164 | Sodium Alginate(20%) | Hydroxypropyl Cellulose, low and high viscosity (5%) | $CaSO_4$ (8%) | Glycerol (25%) V40S Chalk (42%) | 1 |
| 165 | Sodium Alginate (40%) | Hydroxypropyl cellulose, low and high viscosity (10%) | $CaSO_4$ (16%) | Glycerol (25%) V40S Chalk (9%) | 1 |
| 166 | Sodium Alginate (12%) | Hydroxypropyl Cellulose, low and high viscosity (3%) | CaSO4 (4.8%) | Glycerol (25%) V40S Chalk (55.2%) | 1 |
| 167 | Sodium Alginate (60.6%) | Hydroxypropyl Cellulose, low and high viscosity (15.2%) | $CaSO_4$ (24.2%) | | 1.5 |
| 168 | Sodium Alginate (60.6%) | Hydroxypropyl Cellulose, low and high viscosity (15.2%) | $CaSO_4$ (24.2%) | | 2 |
| 169 | Sodium Alginate (60.6%) | Hydroxypropyl Cellulose, low viscosity (15.2%) | $CaSO_4$ (24.2%) | | 2 |
| 170 | Sodium Alginate (60.6%) | Hydroxypropyl Cellulose, low viscosity (15.2%) | $CaSO_4$ (24.2%) | | 1.5 |
| 171 | Sodium Alginate (51.5%) | Hydroxypropyl Cellulose, low and high viscosity (12.9%) | $CaSO_4$ (20.6%) | Glycerol (15%) | 1.5 |
| 172 | Sodium Alginate (41.2%) | Hydroxypropyl Cellulose, low and high viscosity (13.7) | $CaSO_4$ (16.4%) | Glycerol (15%) | 1.5 |
| 173 | Sodium Alginate (45.5%) | Hydroxypropyl Cellulose, low and high viscosity (11.4%) | CaSO4 (18.2%) | Glycerol (15%) Phosphate glass (9.9%) | 1.5 |
| 174 | Sodium Alginate (37%) | Hydroxypropyl Cellulose, low and high viscosity (9.2%) | CaSO4 (14.8%) | Glycerol (23%) Phosphate glass (16%) | 1.5 |
| 175 | Sodium Alginate (33%) | Hydroxypropyl Cellulose, low and high viscosity (8.25%) | Ca Citrate (43.7%) | Glycerol (15%) | 1.5 |
| 176 | Sodium Alginate (33.8%) | Hydroxypropyl Cellulose, low and high viscosity (8.45%) | CaSO4 (13.5%) | Glycerol (15%) Phosphate glass (29.3%) | 1.5 |
| 177 | Sodium Alginate (41.7%) | Hydroxypropyl Cellulose, low and high viscosity (10.4%) | CaSO4 (16.7%) | Glycerol (15%) $NaHCO_3$ (16.25%) | 1.5 |
| 178 | Sodium Alginate (33%) | Hydroxypropyl Cellulose, low and high viscosity (8.3%) | Ca Citrate (43.7%) | Glycerol (15%) | 1.5 |
| 179 | Sodium Alginate (30.1%) | Hydroxypropyl Cellulose, low and high viscosity (15%) | Ca Citrate (39.9%) | Glycerol (15%) | 1.8 |
| 180 | Sodium Alginate (28.8%) | Hydroxypropyl Cellulose, low and high viscosity (14.4%) | Ca Citrate (38.2%) | Glycerol (18.6%) | 1.8 |
| 181 | Sodium Alginate (34.7%) | Hydroxypropyl Cellulose, low and high viscosity (4.3%) | Ca Citrate (46%) | Glycerol (15%) | 1.35 |
| 182 | Sodium Alginate (31.5%) | Hydroxypropyl Cellulose, low and high viscosity (11.8%) | Ca Citrate (41.7%) | Glycerol (15%) | 1.65 |
| 183 | Sodium Alginate (28.6%) | Hydroxypropyl Cellulose, low and high viscosity (3.6%) | Ca Citrate (37.8%) | Glycerol (30%) | 1.35 |
| 184 | Sodium Alginate (31.6%) | Hydroxypropyl Cellulose, low and high viscosity (4%) | Ca Citrate (41.9%) | Glycerol (22.5%) | 1.35 |
| 185 | Sodium Alginate (25.5%) | Hydroxypropyl Cellulose, low and high viscosity (3.2%) | Ca Citrate (33.8%) | Glycerol (37.5%) | 1.35 |
| 186 | Sodium Alginate (54.2%) | Hydroxypropyl Cellulose, low and high viscosity (6.8%) | Ca Citrate (24%) | Glycerol (15%) | 1.35 |
| 187 | Sodium Alginate (42.3%) | Hydroxypropyl Cellulose, low and high viscosity (5.3%) | Ca Citrate (37.4%) | Glycerol (15%) | 1.35 |
| 188 | Sodium Alginate (22.4%) | Hydroxypropyl Cellulose, low and high viscosity (2.8%) | Ca Citrate (29.8%) | Glycerol (45%) | 1.35 |

TABLE 2-continued

| Example | Non foaming cross linking agent | Non-Alginic Foaming agent | Cross-linking agent | Other additions | % binder |
|---|---|---|---|---|---|
| 189 | Sodium Alginate (3.1%) | Hydroxypropyl Cellulose, low and high viscosity (2.1%) | CaSO4 (0.8%) | Glycerol (25.9%) V40S Chalk (68.1%) | 1% |
| 190 | Sodium Alginate (1.8%) | Hydroxypropyl Cellulose, low and high viscosity (1.2%) | $CaSO_4$ (0.9%) | Glycerol (15.3%) V40S Chalk (80.7%) | 1% |
| 191 | Sodium Alginate (1.3%) | Hydroxypropyl Cellulose, low and high viscosity (0.9%) | $CaSO_4$ (0.9%) | Glycerol (10.9%) V40S Chalk (85.9%) | 1% |
| 192 | Sodium Alginate (4.7%) | Hydroxypropyl Cellulose, low and high viscosity (3.2%) | $CaSO_4$ (0.6%) | Glycerol (39.4%) V40S Chalk (52.1%) | 1% |
| 194 | Sodium Alginate (61.6%) | Hydroxypropyl Cellulose, low and high viscosity (7.7%) | Ca Citrate (13.7%) | Glycerol (17.0%) | 1.34 |
| 195 | Sodium Alginate (54.2%) | Hydroxypropyl Cellulose, high viscosity (6.8%) | Ca Citrate (24%) | Glycerol (15%) | 1.35 |
| 196 | Sodium Alginate (48.4%) | Hydroxypropyl Cellulose, low and high viscosity (6.1%) | Ca Citrate (32.1%) | Glycerol (13.4%) | 1.35 |
| 197 | Sodium Alginate (50%) | Hydroxypropyl Cellulose, low and high viscosity (6.3%) | Ca Citrate (22.1%) | Glycerol (21.6%) | 1.35 |
| 198 | Sodium Alginate (38.2%) | Hydroxypropyl Cellulose, low and high viscosity (4.8%) | Ca Citrate (16.9%) | Glycerol (40.1%) | 1.35 |
| 199 | Sodium Alginate (49.4%) | Hydroxypropyl Cellulose, low and high viscosity (4.1%) | Ca Citrate (32.8%) | Glycerol (13.7%) | 1.35 |
| 200 | Sodium Alginate (50.5%) | Hydroxypropyl Cellulose, low and high viscosity (2.1%) | Ca Citrate (33.5%) | Glycerol (13.9%) | 1.35 |
| 201 | Sodium Alginate (51.5%) | Hydroxypropyl Cellulose, low and high viscosity (0%) | Ca Citrate (34.2%) | Glycerol (14.3%) | 1.35 |
| 202 | Sodium Alginate (45%) | Hydroxypropyl Cellulose, low and high viscosity (5.6%) | Ca Citrate (30%) | Glycerol (19.4%) | 1.35 |
| 203 | Sodium Alginate (35.2%) | Hydroxypropyl Cellulose, low and high viscosity (4.4%) | Ca Citrate (23.4%) | Glycerol (37%) | 1.35 |
| 204 | Sodium Alginate (30.7%) | Hydroxypropyl Cellulose, low and high viscosity (3.8%) | Ca Citrate (20.4%) | Glycerol (45.1%) | 1.35 |
| 205 | Sodium Alginate (28.2%) | Hydroxypropyl Cellulose, low and high viscosity (3.5%) | Ca Citrate (18.7%) | Glycerol (29.6%), V40S chalk (20%) | 1.35 |
| 206 | Sodium Alginate (17.6%) | Hydroxypropyl Cellulose, low and high viscosity (2.2%) | Ca Citrate (11.7%) | Glycerol (18.5%), V40S chalk (50%) | 1.35 |
| 207 | Sodium Alginate (15.2%) | Hydroxypropyl Cellulose, low and high viscosity (1.9%) | Ca Citrate (10.1%) | Glycerol (29.6%), V40S chalk (43.2%) | 1.35 |
| 208 | Sodium Alginate (45%) | Hydroxypropyl Cellulose, low and high viscosity (5.6%) | Ca Citrate (30%) | Glycerol (19.4%) | 1.35 |
| 209 | Sodium Alginate (39%) | Hydroxypropyl Cellulose, low and high viscosity (26%) | Tobacco (20%) | Triacetin (15%) | 2.25 |
| 210 | Sodium Alginate (48%) | Hydroxypropyl Cellulose, low and high viscosity (32%) | Tobacco (20%) | | 2.25 |

The invention claimed is:

1. A smokable filler material comprising a foaming agent capable of forming chemical cross-linkages and being present at between about 30% and about 95% by weight of the dry smokable filler material, and a cross-linking agent, wherein the foaming agent capable of forming chemical cross-linkages is a foaming alginate, and wherein, when combined, the foaming agent in the foamed state thereof, and the cross-linking agent provided a stabilised, foamed material.

2. A smokable filler material according to claim 1, wherein the foaming alginate is an esterified alginate.

3. A smokable filler material according to claim 1, wherein the foaming alginate is propylene glycol alginate.

4. A smokable filler material according to claim 1, wherein the cross-linking agent is an agent which provides free calcium ions in aqueous solution.

5. A smokable filler material according to claim 4, wherein the cross-linking agent may be a calcium salt which salt is soluble or sparingly soluble at neutral pH (pH 7.0).

6. A smokable filler material according to claim 4, wherein the cross-linking agent is one or more of calcium sulphate or calcium citrate.

7. A smokable filler material according to claim 4, wherein the cross-linking agent is a calcium salt which is insoluble at neutral pH, which salt becomes soluble or sparingly soluble at acidic pH.

8. A smokable filler material according to claim 7, wherein the cross-linking agent is calcium carbonate or calcium phosphate.

9. A smokable filler material according to claim 4, wherein, the cross-linking agent is a calcium salt which is soluble or sparingly soluble, which salt forms an alkaline solution.

10. A smokable filler material according to claim 9, wherein the cross-linking agent is calcium hydroxide.

11. A smokable filler material according to claim 4, wherein the foaming agent capable of forming chemical cross-linkages is present in the range of about 61% to about 90% by weight of the dry smokable filler material.

12. A smokable filler material according to claim 5, wherein the cross-linking agent is present in the range of between about 1.0% and about 11% by weight of the dry smokable filler material.

13. A smokable filler material according to claim 4, wherein the cross-linking agent is a tobacco material.

14. A smokable filler material according to claim 5, wherein the cross-linking agent is further provided by tobacco.

15. A smokable filler material according to claim 13, wherein the foaming agent capable of forming chemical cross-linkages is present in the range of about 30% to about 80% by weight of the dry smokable filler material.

16. A smokable filler material according to claim 13, wherein the tobacco material is present in the range of about 10% to about 60% by weight of the dry smokable filler material.

17. A smokable filler material according to claim 16, wherein the tobacco is present at about 20% by weight of the dry smokable filler material.

18. A smokable filler material according to claim 14, wherein the calcium salt is present in the range of about 1.0% to about 6% by weight of the dry smokable filler material.

19. A smokable filler material according to claim 1, further comprising a non-alginic foaming agent.

20. A smokable filler material according to claim 19, wherein the non-alginic foaming agent is a foaming agent incapable of forming chemical cross-linkages.

21. A smokable filler material according to claim 19, wherein the non-alginic foaming agent is a foaming surfactant.

22. A smokable filler material according to claim 21, wherein the foaming surfactant is one or more of the group including celluloses capable of foaming, for example hydroxylpropyl cellulose, methyl cellulose or ethyl cellulose, starch, proteins, for example egg albumin, sugar esters.

23. A smokable filler material according to claim 1, further comprising a non-foaming agent capable of forming chemical cross-linkages.

24. A smokable filler material according to claim 23, wherein the non-foaming agent capable of forming chemical cross-linkages is a soluble alginate.

25. A smokable filler material according to claim 24, wherein the non-foaming agent capable of forming chemical cross-linkages is one or more of sodium alginate, ammonium alginate and potassium alginate.

26. A smokable filler material according to claim 1, further comprising a non-alginic foaming agent and a non-foaming agent capable of forming chemical cross-linkages.

27. A smokable filler material according to claim 26, wherein the non-alginic foaming agent is a foaming agent incapable of forming chemical cross-linkages.

28. A smokable filler material according to claim 1, wherein the smokable filler material is a self-supporting foam when dried.

29. A smokable filler material according to claim 28, wherein, when dried, smokable filler material has a moisture content in the range of 0% to about 30%.

30. A smokable filler material according to claim 1, further comprising aerosol generating means.

31. A smokable filler material according to claim 30, wherein the aerosol generating means comprises aerosol forming means.

32. A smokable filler material according to claim 31, wherein the aerosol forming means is one or more of polyhydric alcohols, glycerol, propylene glycol and triethylene glycol, esters or high boiling point hydrocarbons.

33. A smokable filler material according to claim 30, wherein the aerosol generating means is present at between 0% and 65% by weight of the dry smokable filler material.

34. A smokable filler material according to claim 1, further comprising an inorganic filler material.

35. A smokable filler material according to claim 34, wherein the inorganic filler material is a particulate material.

36. A smokable filler material according to claim 34, wherein the inorganic filler material is one or more of perlite, zeolite, alumina, vermiculite, diatomaceous earth, colloidal silica, chalk, magnesium oxide, magnesium sulphate or magnesium carbonate.

37. A smokable filler material according to claim 1, further comprising a colourant and/or a flavourant material.

38. A smokable filler material according to claim 37, wherein the flavourant and/or colourant is one or more of cocoa, liquorice, caramel, chocolate, toffee, tobacco extract flavours, menthol and vanillin.

39. A smokable filler material according to claim 37, wherein the flavourant and/or colourant is present in a range of about 0.2% to about 5% by weight of the dry smokable filler material.

40. A smokable filler material according to claim 1, further comprising a fibrous material.

41. A smokable filler material according to claim 40, wherein the fibrous material is one or more of tobacco, wood pulp, cellulosic or alginic material.

42. A smokable filler material according to claim 1, further comprising a carbonaceous material.

43. A smokable filler material according to claim 1, further comprising a binder material.

44. A smoking article comprising a rod of smoking material enwrapped in a wrapper, the smoking material comprising a blend, which blend incorporates the smokable filler material according to claim 1.

45. A smoking article comprising a rod of smoking material enwrapped in a wrapper, the smoking material consisting essentially of the smokable filler material according to claim 1.

* * * * *